US009687691B1

(12) United States Patent
Atwood

(10) Patent No.: US 9,687,691 B1
(45) Date of Patent: Jun. 27, 2017

(54) STRENGTH TRAINING APPARATUSES

(71) Applicant: Brunswick Corporation, Lake Forest, IL (US)

(72) Inventor: Lee M. Atwood, St. Francis, MN (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 15/292,628

(22) Filed: Oct. 13, 2016

Related U.S. Application Data

(63) Continuation of application No. 14/525,450, filed on Oct. 28, 2014, now Pat. No. 9,492,702.

(51) Int. Cl.
*A63B 21/062* (2006.01)
*A63B 21/078* (2006.01)
(Continued)

(52) U.S. Cl.
CPC ..... *A63B 21/078* (2013.01); *A63B 21/063* (2015.10); *A63B 21/152* (2013.01); *A63B 23/03516* (2013.01)

(58) Field of Classification Search
CPC ..... A63B 21/00058; A63B 21/00061; A63B 21/00065; A63B 21/00069; A63B 21/00072; A63B 21/00178; A63B 21/00181; A63B 21/00185; A63B 21/002; A63B 21/0023; A63B 21/008; A63B 21/0083; A63B 21/0085; A63B 21/0087; A63B 21/02; A63B 21/022; A63B 21/023; A63B 21/025; A63B 21/028; A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/055; A63B 21/0552; A63B 21/0555; A63B 21/0557; A63B 21/06; A63B 21/0615; A63B 21/0616; A63B 21/0617; A63B 21/062; A63B 21/0622; A63B 21/0624; A63B 21/0626; A63B 21/0628; A63B 21/063;
(Continued)

(56) References Cited

U.S. PATENT DOCUMENTS 4,746,115 A 5/1988 Lahman
5,217,422 A * 6/1993 Domzalski ..... A63B 21/154 482/100

(Continued)

*Primary Examiner* — Loan H Thanh
*Assistant Examiner* — Gary D Urbeil Goldner
(74) *Attorney, Agent, or Firm* — Andrus Intellectual Property Law, LLP

(57) ABSTRACT

A strength training apparatus comprises a frame and press arm that is connected to a resistance arm at a pivot point so that the press arm is pivotable with respect to the resistance arm and so that the press arm and resistance arm are pivotable together with respect to the frame. A locking device is configured to retain the press arm in first and second fixed angular pivot positions with respect to the resistance arm. A resistance device is configured to resist pivoting movement of the press arm together with the resistance arm with respect to the frame. A biasing device is configured to bias the press arm with respect to the resistance arm so as to remove any slop in the locking device that otherwise would be caused by gravity, and so that an initial movement of the press arm is resisted by the resistance device.

11 Claims, 5 Drawing Sheets

(51) Int. Cl.
*A63B 23/035* (2006.01)
*A63B 21/00* (2006.01)

(58) Field of Classification Search
CPC ... A63B 21/0632; A63B 21/078; A63B 21/15; A63B 21/151; A63B 21/152; A63B 21/154; A63B 21/155; A63B 21/156; A63B 21/158; A63B 21/159; A63B 21/16; A63B 21/4027; A63B 21/4029; A63B 21/4031; A63B 21/4045; A63B 21/4047; A63B 21/4049; A63B 23/035; A63B 23/03516; A63B 23/03525; A63B 23/03533; A63B 23/03541; A63B 23/12; A63B 23/1209; A63B 23/1227; A63B 23/1236; A63B 23/1245; A63B 23/1281; A63B 69/0057; A63B 71/0054; A63B 2071/0063; A63B 2071/0072; A63B 2071/0081; A63B 2071/009; A63B 2208/0228; A63B 2208/0233; A63B 2225/09; A63B 2225/093
See application file for complete search history.

(56) References Cited

U.S. PATENT DOCUMENTS 5,336,148 A * 8/1994 Ish, III ..... A63B 21/0628 482/137
5,370,595 A 12/1994 Voris et al.
5,597,257 A 1/1997 Habing
5,605,523 A * 2/1997 Ish, III ..... A63B 21/0622 482/138
5,823,920 A 10/1998 Grider
5,954,619 A 9/1999 Petrone
6,387,024 B1 5/2002 Monti et al.
6,508,748 B1 1/2003 Ish, III
7,090,623 B2 8/2006 Stewart et al.
7,101,327 B1 9/2006 Baumler et al.
7,220,221 B2 5/2007 Mosimann et al.
7,377,887 B1 5/2008 Rosenow et al.
7,476,184 B1 * 1/2009 Batca ..... A63B 21/159 482/100
7,771,319 B1 8/2010 Spoeth, Jr. et al.
7,909,742 B2 3/2011 Ish, III et al.
8,512,212 B2 8/2013 Ish, III
8,864,635 B1 10/2014 Atwood et al.
2002/0013200 A1 1/2002 Sechrest et al.
2003/0017918 A1 1/2003 Webb et al.
2003/0138762 A1 7/2003 Eastwood
2004/0029687 A1 2/2004 Hogg
2004/0162195 A1 8/2004 Habing
2006/0019807 A1 1/2006 Husted et al.
2007/0093364 A1 4/2007 Batca
2007/0093365 A1 4/2007 Batca
2007/0173384 A1 7/2007 Sechrest et al.
2008/0026919 A1 1/2008 Lundquist et al.
2008/0064577 A1 3/2008 Pederson et al.
2008/0300116 A1 12/2008 Eder
2009/0209397 A1 8/2009 Miskech
2010/0216600 A1 8/2010 Noffsinger et al.
2011/0092343 A1 4/2011 Habing
2013/0274079 A1 10/2013 Hockridge et al.
2015/0141199 A1 5/2015 Spoeth et al.

* cited by examiner

STRENGTH TRAINING APPARATUSES

CROSS REFERENCE TO RELATED APPLICATION

This application is a continuation of U.S. patent application Ser. No. 14/525,450, filed Oct. 28, 2014, which is incorporated herein by reference in entirety.

FIELD

The present disclosure relates to exercise equipment including strength training apparatuses.

BACKGROUND

The following patents and patent application are incorporated herein by reference.

U.S. Pat. No. 7,717,833 discloses adjustable exercise machines, apparatuses, and systems. The disclosed machines, apparatuses, and systems include an adjustable, reversible mechanism that utilizes pivoting arms and a floating pulley. The disclosed machines, apparatuses, and systems are configured for performing pushing and pulling exercises and may provide for converging and diverging motion.

U.S. Pat. No. 7,377,887 discloses exercise apparatus for guided exercise movement which includes a primary arm pivotally mounted to a frame for pivotal movement about a fixed pivot relative to the frame, a movement arm pivotally mounted to the primary arm for pivotal movement relative to the primary arm about a floating pivot relative to the frame, a stationary cam fixed on the frame, and a follower on the movement arm engaging the stationary cam and guided thereby to control the path of movement of the movement arm about the floating pivot during movement of the primary arm about the fixed pivot. The cam has a cam track surface controlling compound movement of the movement arm.

U.S. patent application Ser. No. 12/899,704, filed on Oct. 7, 2010, discloses resistance training exercise apparatus including a boom arm pivotally mounted to a frame and having an anchor segment pivoting along a first arc about a first pivot point on the frame. A press arm is coupled to a resistance mechanism and is pivotally mounted to the anchor segment of the boom arm and pivots along a second arc about a second pivot point. The user may adjustably vary the location of the second pivot point of the press arm relative to the frame by pivoting the boom arm about the first pivot point.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter. In certain examples disclosed herein, a strength training apparatus comprises a frame and press arm that is connected to a resistance arm at a pivot point so that the press arm is pivotable with respect to the resistance arm and so that the press arm and resistance arm are pivotable together with respect to the frame. A locking device is configured to retain the press arm in at least first and second fixed angular positions with respect to the resistance arm. A resistance device is configured to resist pivoting movement of the press arm together with the resistance arm with respect to the frame. A biasing device is configured to bias the press arm with respect to the resistance arm so as to remove any slop in the locking device that otherwise would be caused by gravity, and so that an initial movement of the press arm is resisted by the resistance device.

BRIEF DESCRIPTION OF THE DRAWINGS

Examples of exercise equipment including strength training apparatuses are described with reference to the following drawing figures. The same numbers are used throughout the drawing figures to reference like features and components.

FIG. 4 is a partial view of the press arm and resistance arm, and the locking device there between.

DETAILED DESCRIPTION OF THE DRAWINGS

Figure 1:
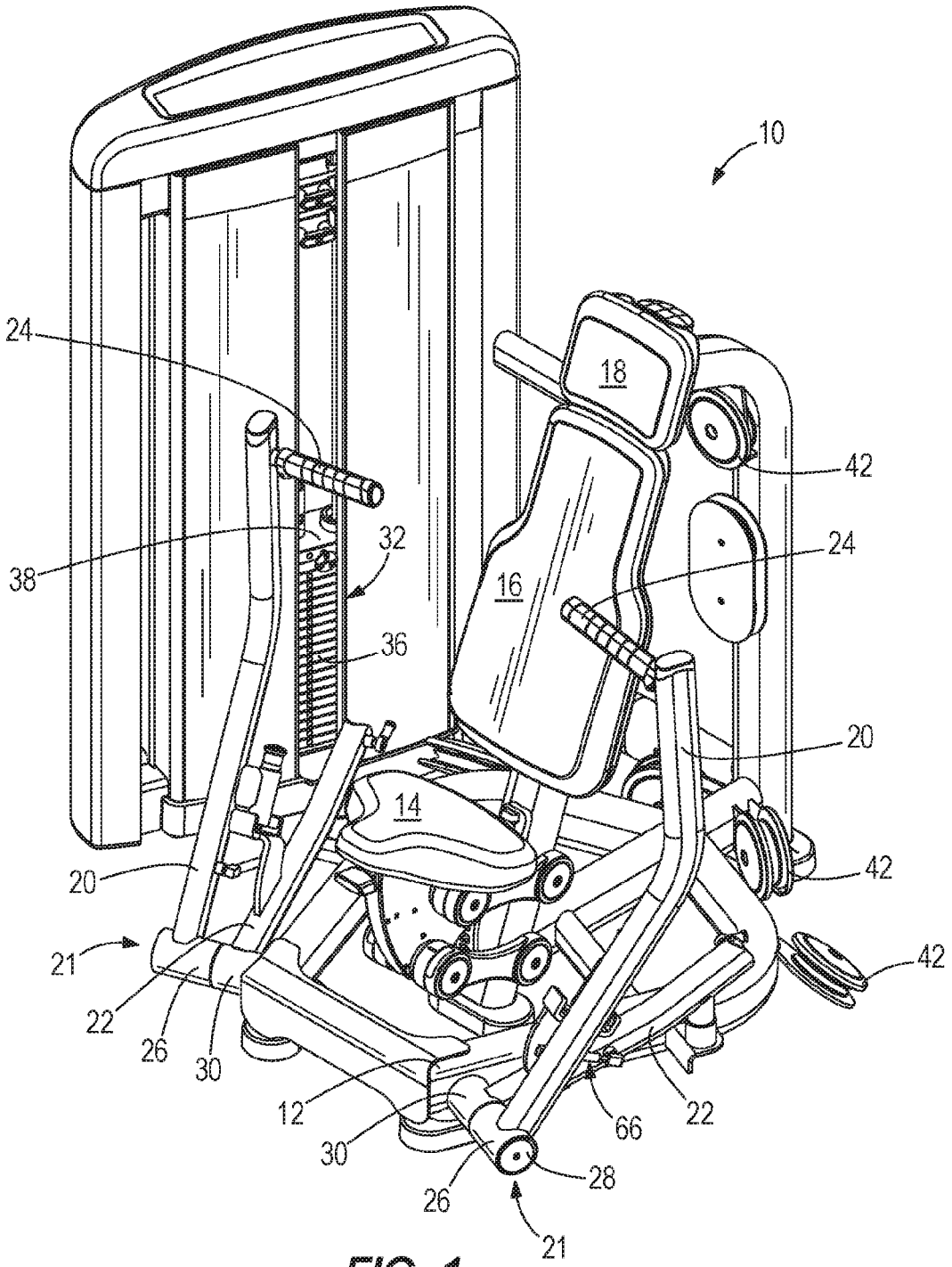
FIG. 1 is a perspective view of a strength training apparatus.

FIG. 1 depicts a strength training apparatus 10. The apparatus 10 includes a frame 12 that supports a seat 14 upon which an operator sits during strength training exercises. A back support 16 and head support 18 extend transversely to the seat 14 and provide further support for the operator during strength training. The particular configuration of the frame, seat and supports can vary from that which is shown and described.

A pair of opposing press arms 20 and a pair of opposing resistance arms 22 are each pivotably connected to the frame 12. The opposing press arms 20 and resistance arms 22 are mirror images of each other and therefore the following description equally applies to both pairs of press arms 20 and resistance arms 22. Each press arm 20 has a handle 24 at one end for grasping by the operator during strength training exercise. Each press arm 20 has an opposite end that is pivotably connected to the frame 12 at a pivot point 21. The exact configuration of the pivot point 21 can vary from that which is shown and described. In this example, the pivot point 21 is configured with a pivot housing 26 on the press arm 20 that freely rotates about a stationary shaft 28 extending from the frame 12. A similar pivot housing 30 on the resistance arm 22 is configured to freely rotate about the stationary shaft 28 such that the press arms 20 and resistance arms 22 are both pivotable about common pivot axis P (see FIG. 4) extending through the pivot point 21.

Figure 2:
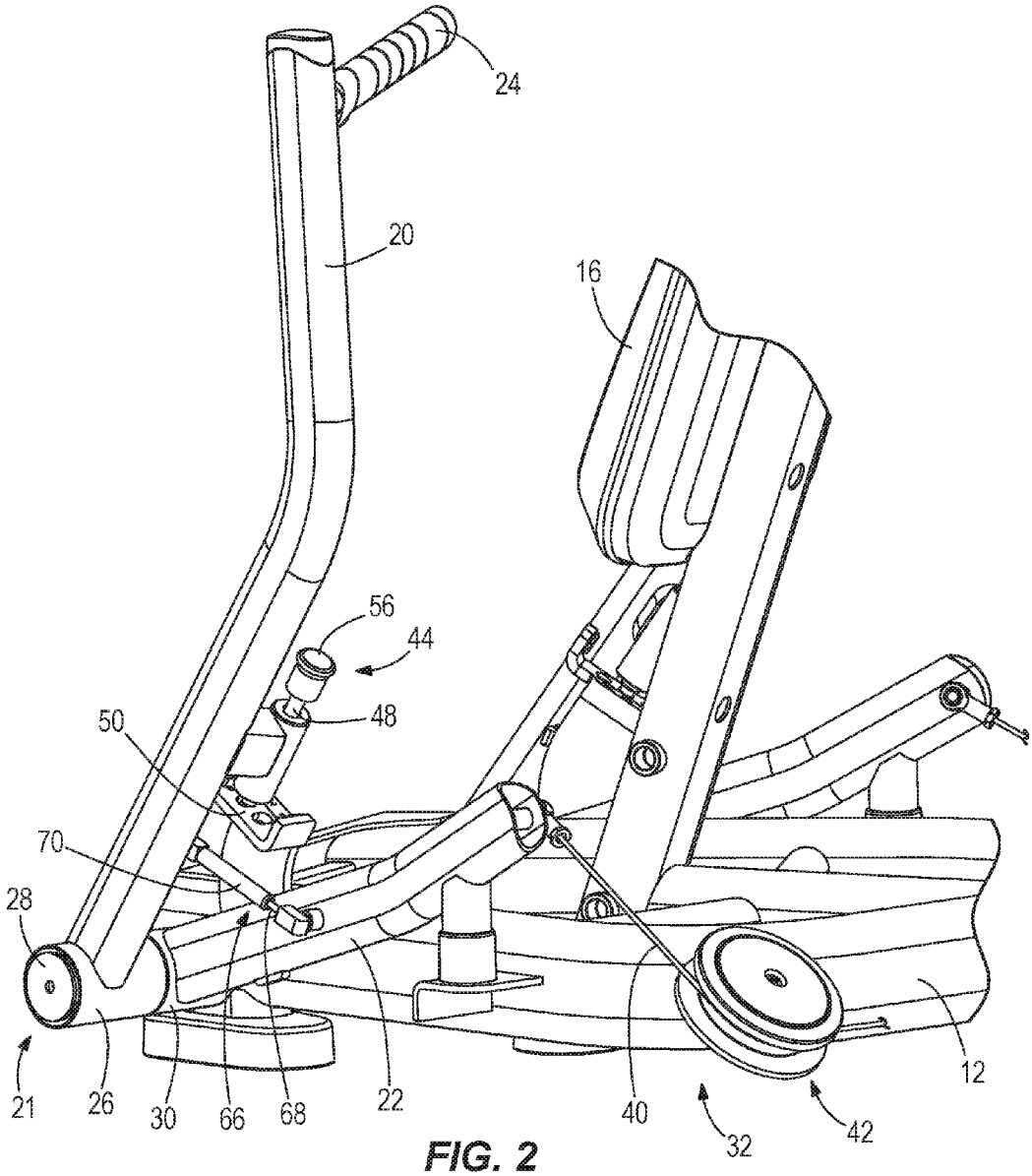
FIG. 2 is a partial view of the strength training apparatus showing a press arm, locking device, resistance device, and biasing device.

Referring to FIGS. 1 and 2, a resistance device 32 is configured to resist pivoting movement of the resistance arm 22 with respect to the pivot point 21. The type of resistance device 32 can vary from that which is shown and described. In this example, the resistance device 32 includes a weight stack 36 having a head plate 38 that is coupled to one end of an elongated cable 40. The cable 40 has an opposite end connected to the resistance arm 22 via a set of pulleys 42 on the frame 12. During strength training exercise, the operator is able to select a number of weights from the weight stack 36 via a selector pin and bayonet (not shown), as is conventional in the art. The operator engages the selector pin with the bayonet so that the selected number of weights from the weight stack 36 are engaged with the cable 40 and thus the resistance arm 22, and so that pressing the pivot arm 20 in the direction of arrow 53 (see FIG. 4) acts on the cable 40 and lifts the selected number of weights from the weight stack 36.

Figure 3:
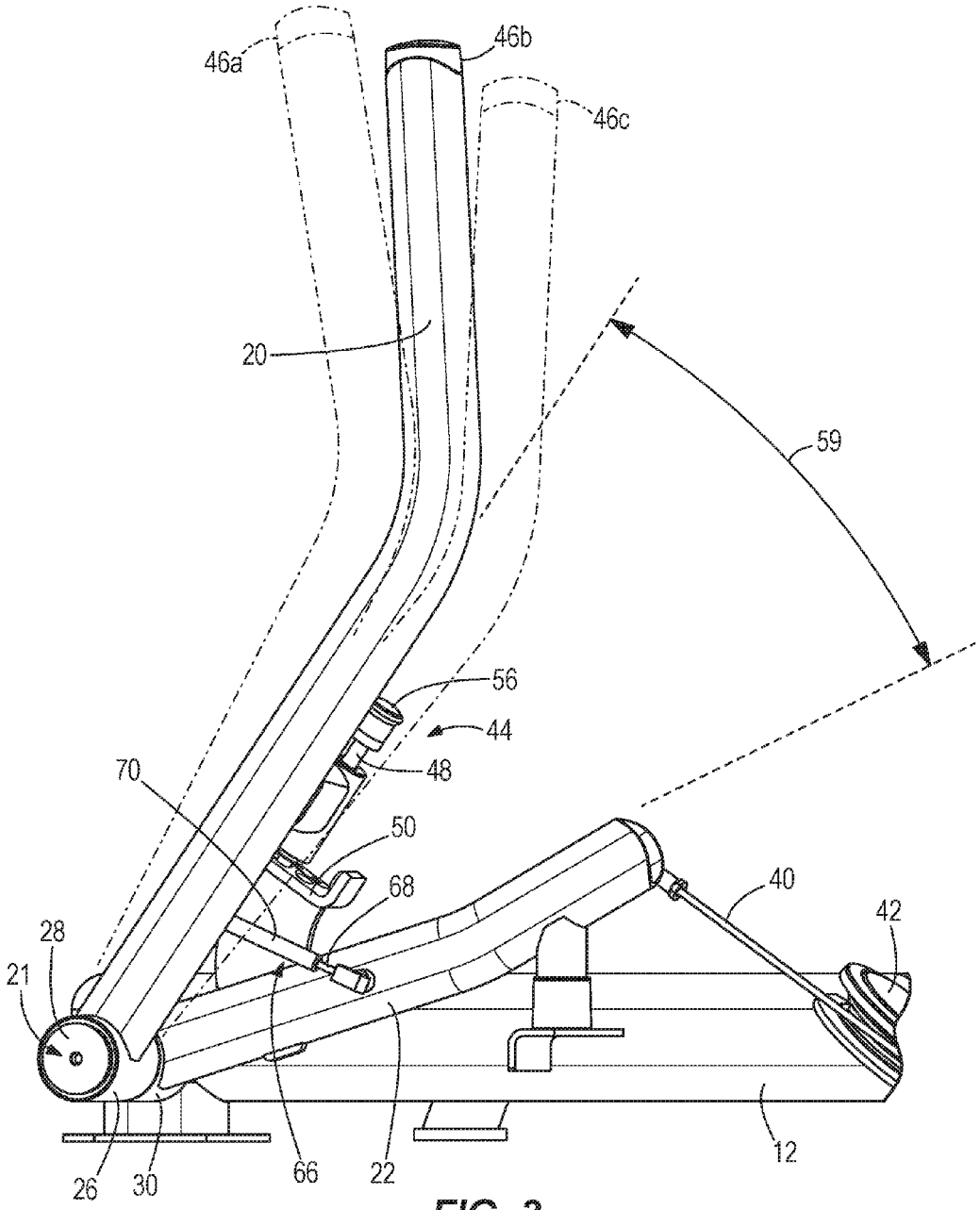
FIG. 3 is a side view showing the press arm and resistance arm at fixed angular positions with respect to each other.
Figure 4:
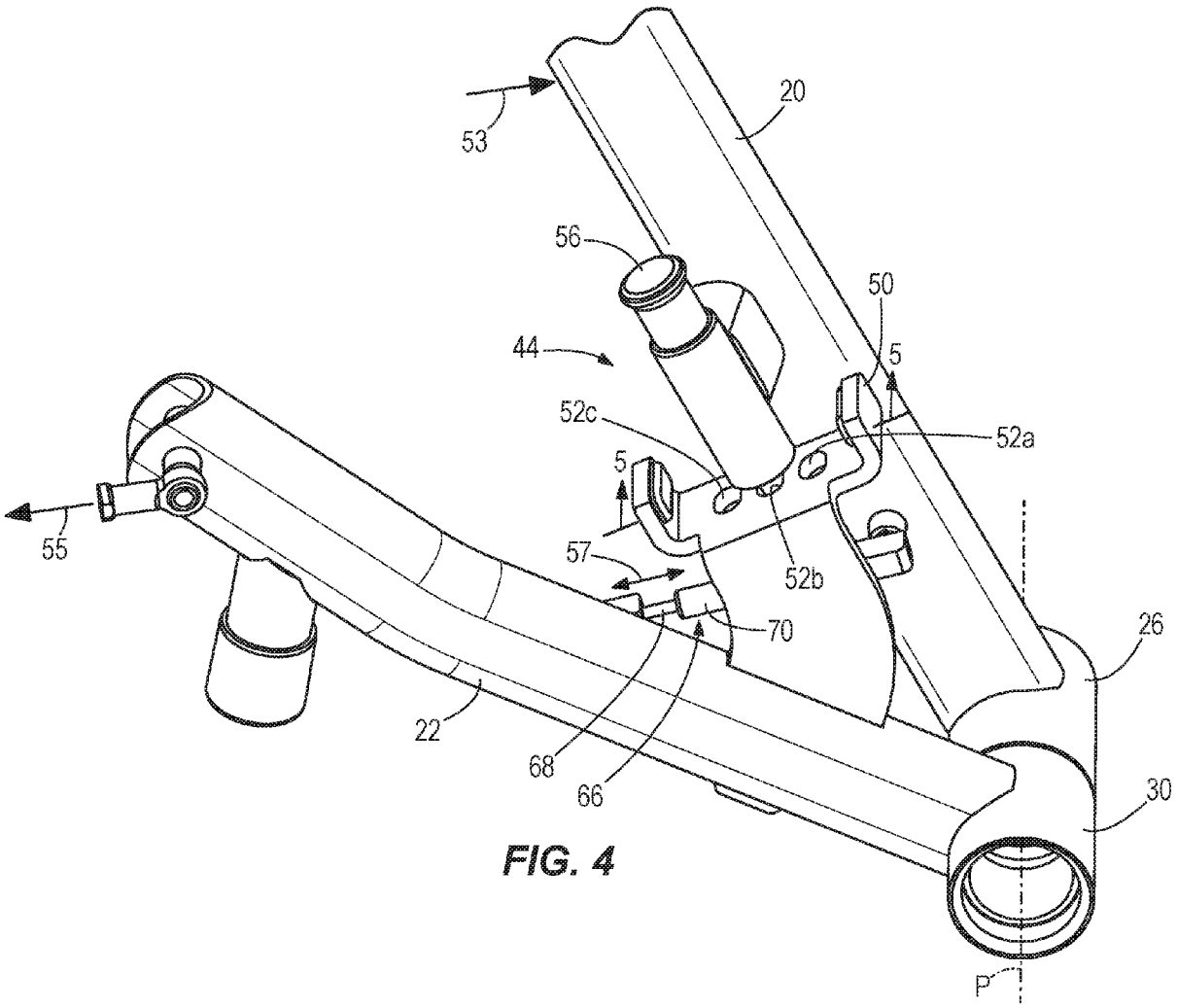
Figure 5:
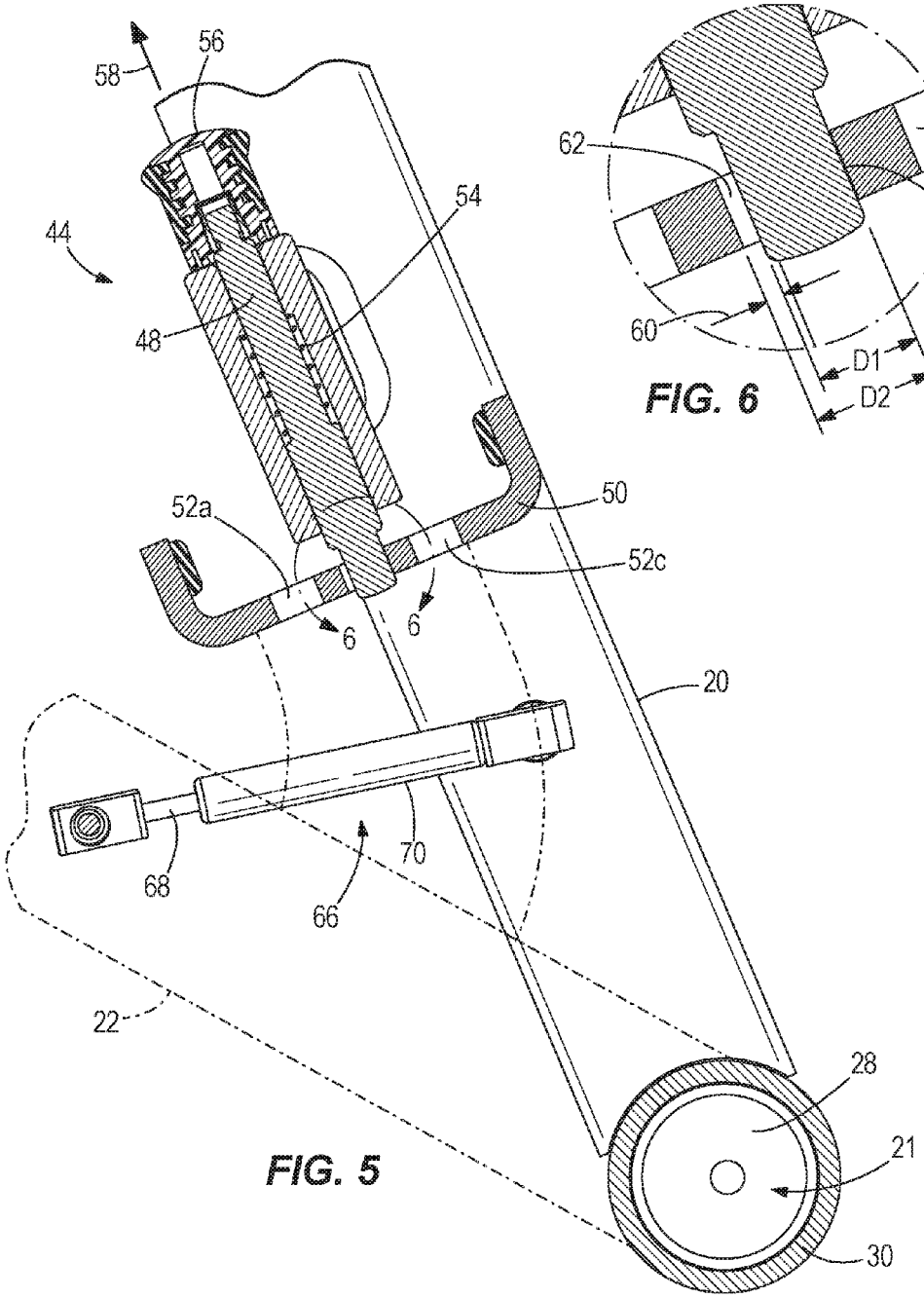
FIG. 5 is a view of section 5-5 in FIG. 4.

As shown in FIGS. 3-5, a locking device 44 is configured to retain the press arm 20 in one of a plurality of fixed angular positions 46*a*, 46*b*, 46*c* with respect to the resistance arm 22. The type of locking device 44 can vary from that which is shown and described. In this example, the locking device 44 includes a selector pin 48 and a bracket 50 having a plurality of selector holes 52*a*, 52*b*, 52*c* that correspond to the noted angular positions 46*a*, 46*b*, 46*c*. The bracket 50 is shown fixed to the resistance arm 22 and the selector pin 48 is shown fixed to the press arm 20; however this configuration could be the opposite. In this example, the selector pin 48 is actuated by a compression spring 54. A handle 56 is positioned on one end of the selector pin 48. Manually pulling on the handle 56 in the direction of arrow 58 compresses the spring 54 while removing the selector pin 48 from the respective hole 52*a*, 52*b*, 52*c*. This allows pivoting movement to occur between the press arm 20 and resistance arm 22, as shown at arrow 59. Releasing the handle 56 allows the spring 54 to push the selector pin 48 towards the bracket 50 and into another respective hole 52*a*, 52*b*, 52*c*, thus angularly locking the orientation of the press arm 20 and resistance arm 22 at one of a different respective acutely angular position 46*a*, 46*b*, 46*c*. Thus, insertion of the selector pin 48 in the selector hole 52*a* retains the press arm 20 in a first fixed angular position 46*a*, insertion of the selector pin 48 in the selector hole 52*b* retains the press arm 20 in a second angular position 46*b* and insertion of the selector pin 48 in the third selector hole 52*c* retains the press arm 20 in a third fixed angular position 46*c*. The number of holes 52 can vary and can alternately include two or more than three holes.

Figure 6:
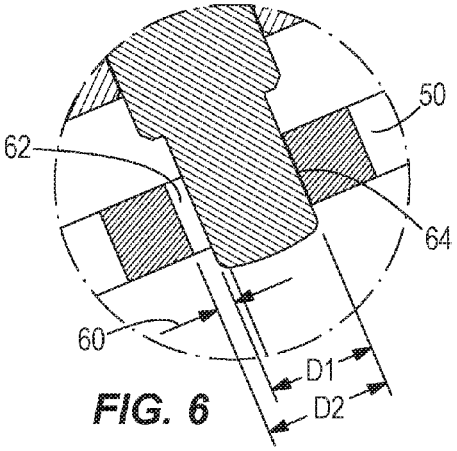
FIG. 6 is a view of section 6-6 in FIG. 5.

Referring to FIGS. 5 and 6, the selector pin 48 has an outer diameter D1 and the selector holes 52*a*, 52*b*, 52*c* have inner diameters D2 that are sized larger than the outer diameter D1 of the selector pin 48. Because of this size difference, a gap 60 is formed between the outer diameter D1 of the selector pin 48 and the inner diameter D2 of the selector holes 52*a*, 52*b*, 52*c*. Because of the orientation of the press arm 20 and resistance arm 22 on the frame 12, gravity ordinarily causes the selector pin 48 to engage with a first side 62 of the inner diameter D1 of the selector holes 52*a*, 52*b*, 52*c* when the press arm 20 is at rest. Thus ordinarily the gap 60 would be on the opposite side of that shown in FIG. 6. When the operator grasps and pushes on the handles 24 to press on the press arm 20 in an exercise motion (see arrow 53), the selector pin 48 must initially move from the first side 62 of the respective hole 52*a*, 52*b*, 52*c* into engagement with the second side 64 of the selector hole 52*a*, 52*b*, 52*c* before pivoting motion of the resistance arm 22 and resistance by the resistance device 32. This is referred to in the art as "slop", wherein a smooth interaction between the operator and the resistance device 32 is not provided. Instead, an initial pivoting movement of the press arm 20 is required, after which the selector pin 48 engages with the second side 64 of the selector holes 52*a*, 52*b*, 52*c* in the bracket 50 and then causes the resistance arm 22 to pivot about the axis P, which is resisted by the resistance device 32. This causes a clunking sound and does not provide a smooth feeling to the operator.

The present inventors have identified this problem and have solved it by providing the apparatus 10 with a biasing device 66 configured to bias (force) the press arm 20 with respect to the resistance arm 22 so as to eliminate or remove the noted slop in the locking device 44 that otherwise would be caused by gravity, and so that an initial movement of the press arm 20 also causes movement of the resistance arm 22 and is resisted by the resistance device 32. In this example, the biasing device 66 pushes the press arm 20 away from the resistance arm 22 (see arrow 57); however the biasing device 66 could instead pull the respective press and resistance arms 20, 22 together, depending upon the orientation of the respective arms 20, 22 with respect to gravity. The type and configuration of the biasing device 66 can vary from that shown. In this example, the biasing device 66 includes a piston rod 68 having a piston (not shown), and cylinder 70, which together form a gas spring. A suitable gas spring can be purchased from Stabilus, Model No. PN64891P. The gas spring is a self-contained unit that is filled with pressurized gas, which allows the gas spring to store energy. Pushing on the gas spring forces the piston rod 68 and piston into the cylinder 70 and compresses the gas. The pressure of the gas pushes the piston back out again. Gas inside the cylinder 70 can flow through or around the piston from one side to the other as it moves back and forward. Surface areas on the piston determine the internal pressures. It should be noted that the biasing device 66 does not have to be a gas spring. In other examples, the biasing device 66 could be a torsion spring, vacuum cylinder and/or the like. Any suitable device for providing compression and/or tension could be utilized. In this example, the piston rod 68 is fixed to the press arm 20 and the cylinder 70 is fixed to the resistance arm 22; however this arrangement could be the opposite.

During normal operation, air pressure in the gas spring forces the piston rod 68 outwardly with respect to the cylinder 70 and thus forces the arms 20, 22 apart from each other (arrow 57) such that the outer diameter D1 of the selector pin 48 remains engaged with the second side 64 of the selector hole 52*a*, 52*b*, 52*c* when the locking device 44 is in the locked position shown in FIGS. 5-6. This causes an initial pivoting movement of the press arm 20 by the operator (at arrow 53) to be resisted by the resistance device 32. Because the gas spring forces the outer diameter D1 into engagement with the second side 64, initial pivoting of the press arm 20 (see arrow 53) also causes initial pivoting of the resistance arm 22, which is resisted by the cable 40 and weights 36 (see arrow 55). This advantageously avoids the noted clunking noise caused by slop in the locking device 44 and provides a smooth feeling to the operator.

In the present description, certain terms have been used for brevity, clearness, and understanding. No unnecessary limitations are to be inferred therefrom beyond the requirement of the prior art because such terms are used for descriptive purposes only and are intended to be broadly construed. The different apparatuses described herein may be used alone or in combination with other apparatuses. Various equivalents, alternatives, and modifications are possible within the scope of the appended claims.

What is claimed is:

1. A strength training apparatus comprising:

a frame;

a resistance arm that is pivotable with respect to the frame about a pivot axis;

a press arm that is pivotable with respect to the resistance arm about the pivot axis;

a locking device that is configured to retain the press arm and resistance arm at first and second fixed, acutely angular pivot positions with respect to each other, such that the press arm and resistance arm are pivotable together about the pivot axis while remaining in the respective first and second fixed, acutely angular pivot positions;

a resistance device that is configured to resist pivoting movement of the press arm together with the resistance arm about the pivot axis;

a biasing device having a first end portion coupled to the press arm and a second end portion coupled to the resistance arm, wherein the biasing device extends transversely to the press arm and resistance arm, and wherein the biasing device is configured to bias the press arm with respect to the resistance arm so as to remove any slop in the locking device that otherwise would be caused by gravity, so that an initial movement of the press arm is immediately resisted by the resistance device.

2. The apparatus according to claim 1, wherein the biasing device is capable of extending generally perpendicularly to the press arm.

3. The apparatus according to claim 1, wherein the locking device comprises a selector pin and a bracket, the bracket having at least first and second selector holes, wherein insertion of the selector pin in the first selector hole retains the press arm in the first fixed angular pivot position, and wherein insertion of the selector pin in the second selector hole retains the press arm in the second fixed angular pivot position.

4. The apparatus according to claim 3, wherein the selector pin has an outer diameter and wherein the first and second selector holes each have an inner diameter that is sized larger than the outer diameter of the selector pin, such that the slop is formed by a gap between the outer diameter of the selector pin and the inner diameter of each of the first and second selector holes.

5. The apparatus according to claim 4, wherein gravity causes the selector pin to engage with a first side of the inner diameter of each of the first and second selector holes and wherein the biasing device acts against gravity so as to cause the selector pin to engage with an opposite, second side of the inner diameter of each of the first and second selector holes.

6. The apparatus according to claim 5, wherein the selector pin is axially biased by a spring into the first and second selector holes.

7. The apparatus according to claim 1, wherein the biasing device comprises a piston rod and cylinder.

8. The apparatus according to claim 7, wherein the piston rod and cylinder are part of a gas spring.

9. The apparatus according to claim 1, wherein the biasing device pushes the press arm away from the resistance arm.

10. The apparatus according to claim 1, wherein the resistance device comprises a cable having a first end connected to the resistance arm and an opposite second end connected to a weight.

11. The apparatus according to claim 10, wherein the weight is part of a weight stack.

* * * * *